United States Patent [19]

Dodds

[11] Patent Number: 4,626,387

[45] Date of Patent: Dec. 2, 1986

[54] EVAPORATIVE CONDENSER WITH HELICAL COILS AND METHOD

[75] Inventor: Diego E. F. Dodds, Buenos Aires, Argentina

[73] Assignee: Leonard Oboler, Key Biscayne, Fla.; a part interest

[21] Appl. No.: 738,704

[22] Filed: May 29, 1985

[51] Int. Cl.[4] ..... B01F 3/04

[52] U.S. Cl. ..... 261/153; 165/110; 261/DIG. 11

[58] Field of Search ..... 261/153, DIG. 11; 165/110

[56] References Cited

U.S. PATENT DOCUMENTS

| | | | |
|---|---|---|---|
| 1,327,599 | 1/1920 | Hunt et al. | 261/153 |
| 1,905,470 | 4/1933 | Jacobus | 165/110 |
| 2,141,899 | 12/1938 | Bennett | 165/110 |
| 2,235,806 | 3/1941 | Walker et al. | 165/110 |
| 3,053,512 | 9/1962 | Soudan et al. | 165/82 |
| 3,146,609 | 9/1964 | Engalitcheff, Jr. | 165/111 |
| 3,861,460 | 1/1975 | Lenhardt | 165/111 |
| 3,899,023 | 8/1975 | Zander et al. | 165/111 |
| 3,922,880 | 12/1975 | Morris | 261/153 |
| 4,443,389 | 4/1984 | Dodds | 261/153 |

FOREIGN PATENT DOCUMENTS

| | | | |
|---|---|---|---|
| M17885 | 12/1956 | Fed. Rep. of Germany | 261/153 |
| 2345243 | 3/1975 | Fed. Rep. of Germany | 165/110 |
| 2439562 | 2/1976 | Fed. Rep. of Germany | 165/110 |
| 408131 | 4/1974 | U.S.S.R. | 165/110 |

*Primary Examiner*—Tim Miles

*Attorney, Agent, or Firm*—Jim Zegeer

[57] ABSTRACT

A high efficiency evaporative condenser has spaced upper vapor supply and lower condensate collection headers coupled by a plurality of thin walled helical coils defining a plurality of helical flow paths. Maximum latent heat transfer is achieved by assuring rapid cleaning of liquid condensate from interior surfaces of the pipes cleaning the flow paths, continuous air-water wetting of the external surfaces and self-cleaning of the external surface of the coils defining the flow paths. Oil and condensate in the upper vapor supply header is provided with a flow path to the lower condensate collection header without lowering the heat transfer efficiency of the helical coils and vapor in the condensate header is vented to the vapor supply header to equalize pressure. A barometric leg is formed between the ends of the helical coil and condensate collection header to form a liquid column which exerts a negative pressure on the vapor in each helical path and prevent vapor lock. The headers are maintained in fixed relation so that the helical coils are constrained to expand radially for better self-cleaning of scale and encrustation. Air/water droplet contact with the coil is maximized due to the helical coil arrangement.

31 Claims, 15 Drawing Figures

FIG. 2a PRIOR ART
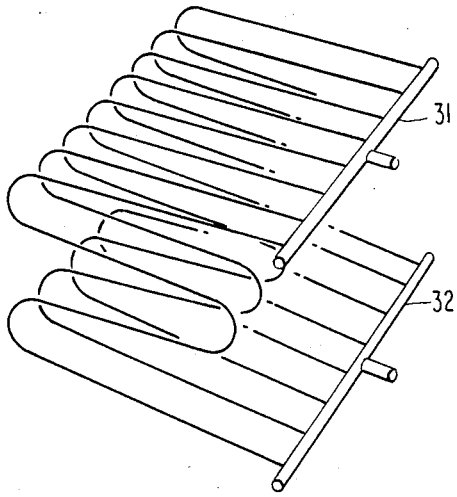
FIG. 2c
PRIOR ART
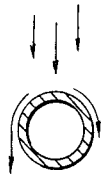
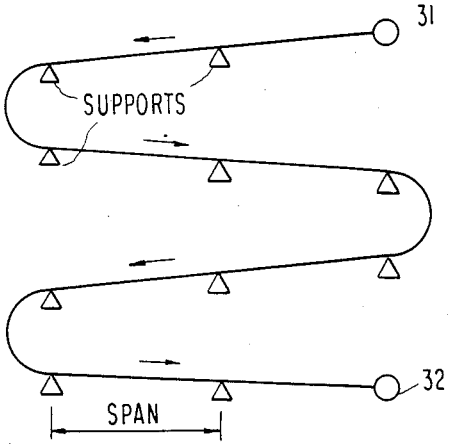
FIG. 2b
PRIOR ART
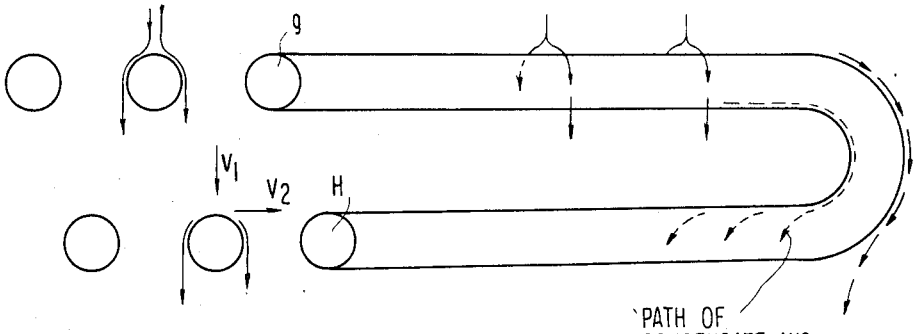
FIG. 2d
PRIOR ART
PATH OF CONDENSATE AND OIL ON "U" OR VERTICAL HAIRPIN TURN OF PRIOR ART TUBE PACK FIG. 8a
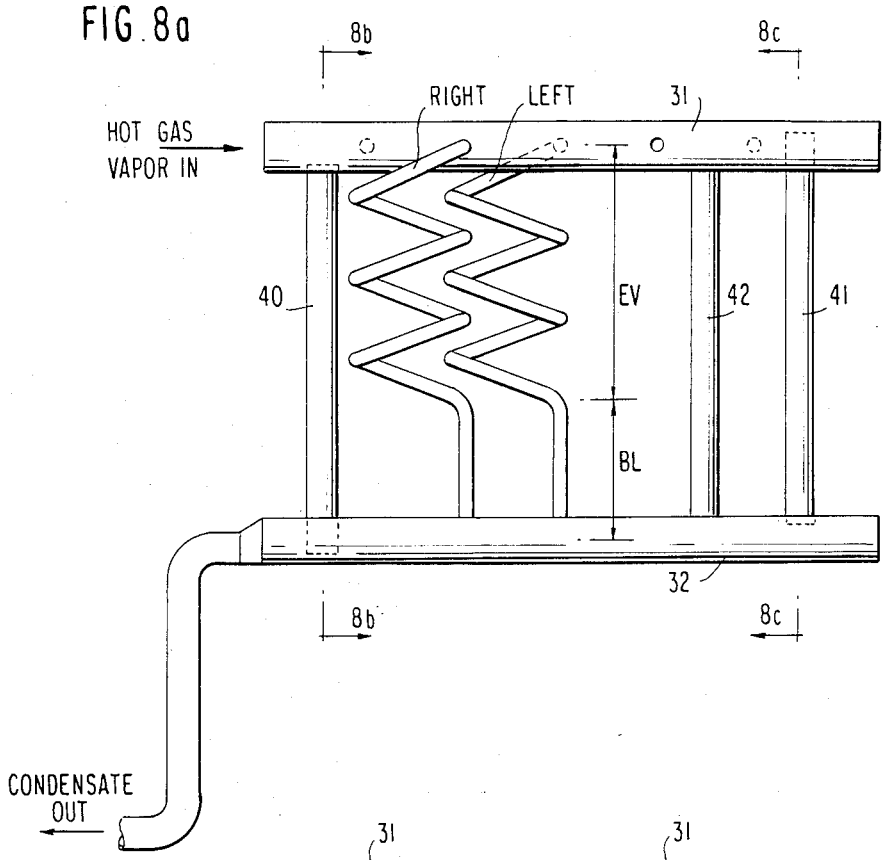
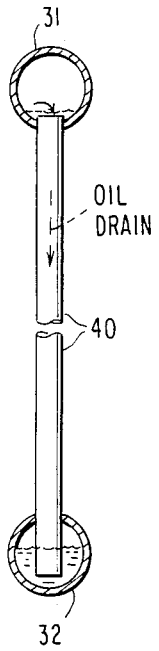
FIG. 8b
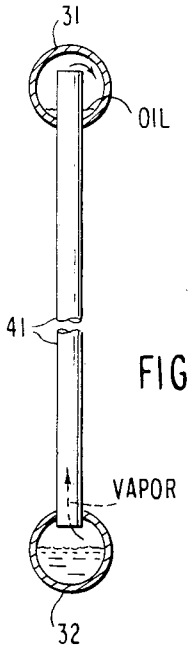
FIG. 8c

EVAPORATIVE CONDENSER WITH HELICAL COILS AND METHOD

BACKGROUND AND BRIEF DESCRIPTION OF THE INVENTION

Evaporative condensing is still by far the most economical means to remove latent heat. Other condensing methods are based on using dry air or a cooling tower. However, this holds true as long as the heat transfer surfaces on both sides of the tubes are kept clean and free of thermal insulating films such as oil, scale, algae growth, etc.

The basic equation for sizing any heat exchanger is:

$$Q = LMTD \times F \times U \quad \text{(Equation No. 1)}$$

where,

Q=total heat transferred between the fluids on either side of the pipe walls (BTU/Hour)

LMTD=log mean temperature difference between the fluids (degrees F.)

F=heat transfer surface (in square feet)

U=overall heat transfer coefficient or specific thermal capability of the heat exchanger (BTU/hr.-Ft$^2$-°F.)

The heat transfer surface (F) is a function of the coefficient U and shall vary inversely with U.

The LMTD is a function of the cycrometric conditions of the outside air entering evaporative condensor as well as the ratio of the air flow versus the refrigerant to be condensed.

Cycrometric conditions involve humidity and temperature of the air e.g., cycrometric conditions are the outside air.

Therefore, once the designer has set the value of LMTD, the amount of heat transfer surface required will be defined by the value of U. The ability to convey heat between both fluids is equal to the reciprocal of the summation of all thermal resistances encountered:

$$U = \frac{1}{R_1 + R_2 + R_3 \ldots Rn} \quad \text{(Equation No. 2)}$$

A typical evaporative condensor arrangement is shown in FIG. 1. The hot vapor to be condensed reaches a distribution header 31 and is introduced into the pipes which comprise the heat exchanger assembly 10. The condensed liquid inside of the tubes will flow down by gravity into the liquid header 32. Fresh outside air is constantly flowing through the unit. A pump 5 draws water from the basin 4 and takes it to nozzles 3 where it is sprayed over heat exchanger 10. This water picks up heat from the external surface of the pipes and surrenders it to the air by vaporizing a small fraction of its total mass. This process is termed evaporative and there is simultaneous transfer of heat and mass between both fluids, air and water as they come into direct contact with each other.

The thermal resistance R1, R2, R3 as indicated in equation No. 2 have been replaced in equation No. 3 by their corresponding physical properties:

$$U = \frac{1}{\frac{1}{h_r} + \frac{t_o}{k_o} + \frac{t_p}{k_p} + \frac{t_s}{k_s} + \frac{1}{h_w}} \quad \text{(Equation No. 3)}$$

where,

Hr=film factor corresponding to the condensing refrigerant inside the tubes.

Hw=the film factor of the water wetting the outside of the tubes.

Lo=the thickness of the oil film.

Lp=the thickness of the tube material.

Ls=the thickness of the scale on the outside of the tubes.

Ko=the conductivity of the oil.

Kp=the conductivity of the tube material.

Ks=the conductivity of the scale deposit.

The heat exchanging process commences in the inside of the tubes and makes its way to the outside. In any evaporative condensor there are four distinctive stages of the cooling process.

Stage 1 convection of the heat from the vapor inside the tubes to the tube wall, Stage 2 transmission of the heat through the tube wall, Stage 3 the water which is wetting the external side of the tube absorbs the heat coming through the wall of the tube, Stage 4 the water releases the heat to the surrounding air.

Equation No. 3 covers the overall coefficient U for stages 1, 2, and 3.

Stage 4 is the evaporative stage of the heat exchanging process. Here the external surface of the tubes of the heat exchanger 10 are only a part of the total evaporative surface. Evaporative surface is made up of the said tube services plus the curtains of water and droplets which fall all the way down into the basin 4.

The object of the present invention is to obtain the highest or best heat transfer conditions for each and all stages since whichever stage has the lowest value that stage shall define the overall heat transfer capability of the entire evaporative condenser. According to the invention, by raising the efficiency of latent heat removal, the physical size of the overall structure can be reduced.

BRIEF DESCRIPTION OF THE DRAWINGS

The above and other objects, advantages and feature of the invention will become more clearly understood from the following detailed description and accompanying drawings wherein:

FIG. 2*a* is a typical horizontal tube pack system of the prior art, FIG. 2*b* is a diagrammatically illustration of the support system for the tubes of FIG. 2*a*, FIGS. 2*c* and 2*d* illustrate the manner of run-off of coolant liquid for the tubes of FIG. 2*a*, FIG. 8*a* is a diagrammatic illustration of the spacer structure for the upper and lower header, FIG. 8*b* is a sectional view on lines 8*b*—8*b* of FIG. 8*a* and shows the drain of oil and/or condensate from an upper header supply run to a lower collection header run, FIG. 8*c* is a sectional view on lines 8*c*—8*c* of FIG. 8*a* and shows the flow of vapor from the condensate collection header run to the vapor supply header.

Figure 1:
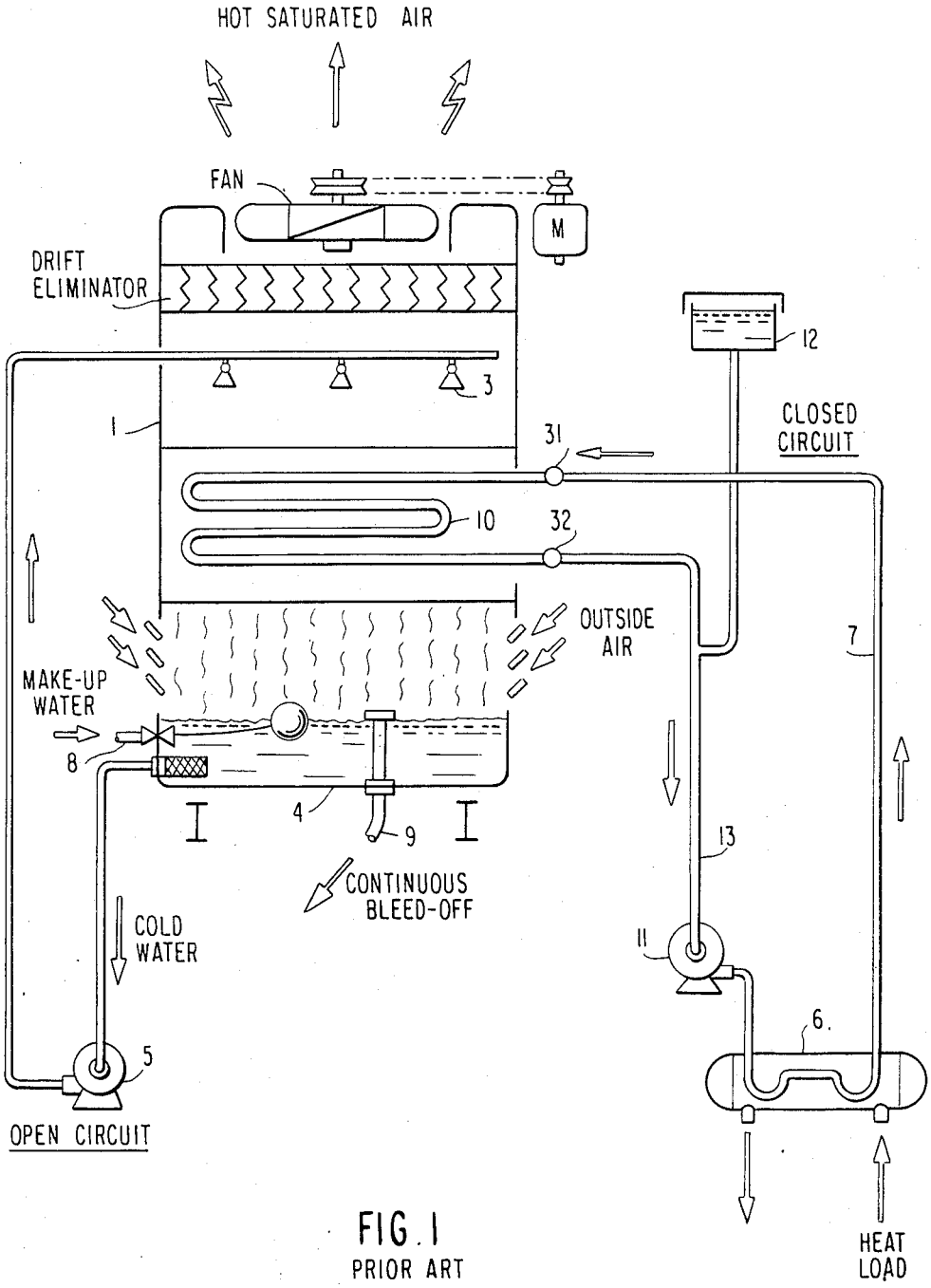
FIG. 1 PRIOR ART
FIG. 1 is a schematic diagram of a typical evaporative condenser arrangement.
Figure 3:
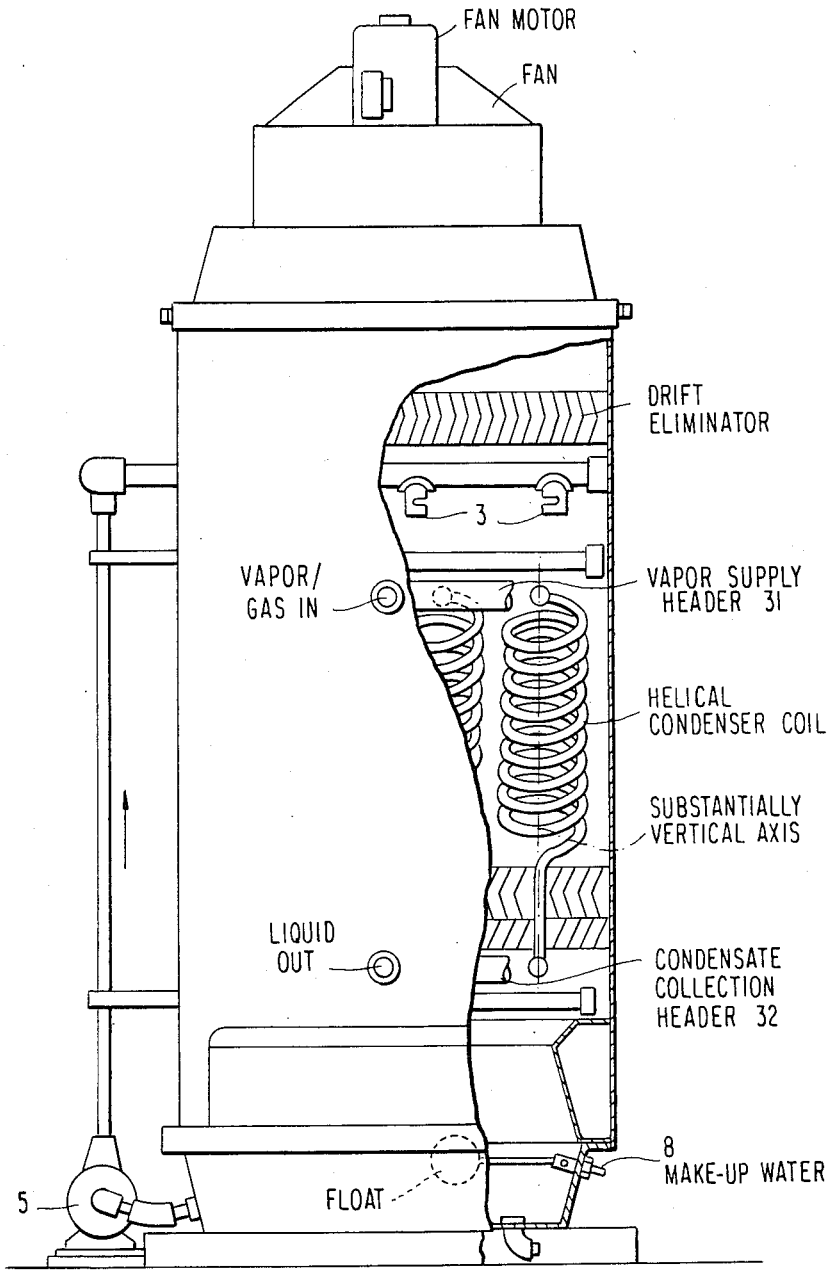
FIG. 3 is a diagrammatic illustration of an evaporative condenser system incorporating the helical tube pack incorporating the invention.

In stage 1, the value of Hr is a function of velocity of the fluid, the hydraulic radius of the tube, the Reynolds number, etc. pertaining to the refrigerant. Again, the value of Hr varies along all the length of the heat exchanger tube on account of the changes occurring in the fluid which starts almost 100 percent vapor or gas or gaseous state then becomes a mixture of vapor and liquid until it reaches an all liquid state at the end.

The absolute quantity of oil carried over by the refrigerant as it leaves the compressor or even after going through the oil separator, is not the significant factor. What really counts is how much of this oil remains adhered and lining the inside wall surface of the heat exchanger tubes.

It can be summarized that the way to improve the heat convection condition of stage 1 is to rid the inside tube walls of both the liquid droplets or film or refrigerant as well as any oil film.

Stage 2 is controlled by the thickness of the tube wall and the thermal conductivity of the material used for these tubes. The thinner the wall and higher its conductivity, the greater shall be the heat transfered. In Stage 3, the predominant factor is the scale or fouling of the external surface of the tubes.

As explained above, the evaporative cooling process is also a mass transfer process therefore, the water carried away by the air leading the condenser must be replaced with fresh makeup. Except where this makeup water contains zero hardness, there will be a concentration of solids in the water sprayed over the heat exchanger 10. This higher content of hardness must and shall precipitate and tend to grip on to the tube surfaces as soon as the temperature of the water is raised beyond its condition of equallibrium. Fouling due to scale build-up is probably the main reason that has handicapped the extensive usage of evaporative condensers. The scale build-up demands a constant attention or else the entire installation will be penalized with higher and higher condensing temperatures as time goes by. In my U.S. Pat. No. 4,443,389, and in my Argentinian Pat. No. 195,525 of Oct. 15, 1973, and my Argentinian Pat. No. 206,846 of Aug. 23, 1976, I disclose various helical tube structures and mounting arrangements which have proved successful in avoiding scale build-up. The value of film factor Hw is a function of the velocity of the water as it moves on the outside surface of the tubes. The higher the velocity, the better shall be the convection of the heat.

Finally, the transfer of heat in stage 4 requires, among other factors, time, turbulence and temperature. Time and turbulence are defined by the configuration of the tubes and the way these tubes intercept the falling water. The actual time both fluids air and water are in contact with each other is attained by means of true surface of heat exchange as well as by the length of travel.

As noted above, the heat exchanger 10 shown in FIG. 1, is a representation of the type currently being used in the industry. A series of sections are connected at the top to a distribution header 31 and at the bottom to a condensate or liquid collecting header 32. Each section is formed by a continuous tube with a certain number of 180 degree elbows so as to obtain a "quasi" horizontal run of pipe between each 180 degree elbow. The minimum pitch given to each pipe is to assure the flow of the oil and the condensed liquid.

This heat exchanger 10 has been detailed further in FIGS. 2*a*, 2*b*, 2*c* and 2*d*. The number of pipe supports needed and/or the span between the pipe supports will depend on the tensile strength and the wall thickness of the pipes being used.

The most common materials used in the industry are carbon steel pipes hot dipped and zinc coated after fabrication. The average pipe is 1"OD and wall thickness 1.6 millimeters equal to 0.063".

FIGS. 3–8 illustrate an evaporative condenser fitted with a heat exchanger 10 of the design incorporating the present invention.

A comparison of both designs of heat exchangers, FIG. 1 versus FIGS. 3–8 will show the benefit to be accrued with the proposed invention:

(a) improved heat transfer,
(b) fabrication,
(c) compactness,
(d) reduced weight,
(e) maintenance.

Any evaporative condenser used for a mechanical refrigeration system, ammonia, freon, methylchloride, etc. will be subjected to relatively high pressures in the range of 300 psig. This means that any coupling joint or welding is a potential source of leaks therefore, for practical reasons, the ideal design calls for the minimum number of joints.

The ID or internal cross-section of the pipe is a function of velocity. The velocity of the fluid will account for the film resistance Hr in equation No. 3.

The higher the velocity the better the heat transfer but, here again, there are limitations of this velocity since the friction losses will vary as a square of the fluid velocity. The noise level also increases with a high exponertial of the velocity.

Finally, a compromise must also be reached to attain a reasonable pipe size with enough wall thickness to insure that the pipe will resist the pressure of the fluid as well as that it will not sage between the supports.

Another parameter to take into account is the thermal expansion of the pipe and its effect both mechanically creating structural stresses as well as to the deformation which could cause pockets on the horizontal sections of the pipes.

According to this invention, the banks of tubes are arranged in a manner to obtain the following:

(a) fast elimination of the oil film and of the condensed refrigerant so that the tube surfaces are used to their maximum capability to eliminate latent heat from the remaining vapor,
(b) enhance the contact of the air with the water,
(c) compactness to reduce overall volume of the unit.

Tests comparing two heat exchangers of the designs depicted in FIG. 1 and FIGS. 3–8, inclusive, showed that for equal tube surfaces, the result was heat transfer of approximately 20 percent higher using the teachings of this invention.

The conventional heat exchanger tube or pipe pack shown in FIGS. 2*a*, *b* and *c* is made up of a number of straight runs of pipe with a 180 degree bend at each end. The pipes are pitched down very slightly and returned with 180 degree elbow. Both the oil and liquid refrigerant flow down relatively slow towards the lower part of the tube which enables the formation of heat resistance films. Due to the quasi-horizontal position of the pipes, the force of gravity is not playing any significant role.

In FIGS. 3–8, the condensing coils or pipes have the shape of a helix or spring. Assuming mass velocities then for the heat exchanger, according to the invention, both gravity and centrifugal force will exert positive effects. Oil and condensed liquid will concentrate forming a thin stream which will follow a permanent path until they are drained out into header 32 thus reducing the formation of a film on the wall. Even at low gas or vapor velocity, the flow will be turbulent (high Reynolds number) on account of the spiral shape of the coil. (Ratio radius, hydraulic radius and diameter of the rings). The elimination of heat resistive films, the turbulent flow and the fast drainage of the coils result in a noticeable increase of heat transfer.

As for point B referred to above, enhance the contact between the air and the water, this is what happens. In FIG. 2*d* the pipes are almost horizontal. The water simply splashes on the pipes and immediately falls off the surface and drops down until it hits the next row of pipes. The velocity of the water over the pipe surface is very low since for G level down to J level it is only 4 to 6 inches drop and the velocity is equal to the square root of $\sqrt{2gh}$. Everytime the water hits a pipe, its velocity is reduced to almost 0 because its vertical ports are intercepted by the new pipe.

Also, any water which is retained on the surface of the pipe and flows down longitudinally towards the end of the pipe will fall off when it reaches the 180 degrees elbow. It will drop straight down and it will be lost for further wetting of pipe in lower layers.

According to this invention, the water wetting the top rings of the coil or helix will continue flowing down riding the surface of the pipe. The height of the water drop H is computed equal to the distance between headers 31 and 32. The final velocity shall be equal to the free fall square root of $\sqrt{2gh}$ less the friction loss of the film over the surface of the pipe.

It is obvious that both the surface wetting action as well as the velocity of the water will be greater on the helical coil than on a conventional horizontal tube pack. This will have a direct effect on the film factor Hw in equation No. 3.

Figure 4:
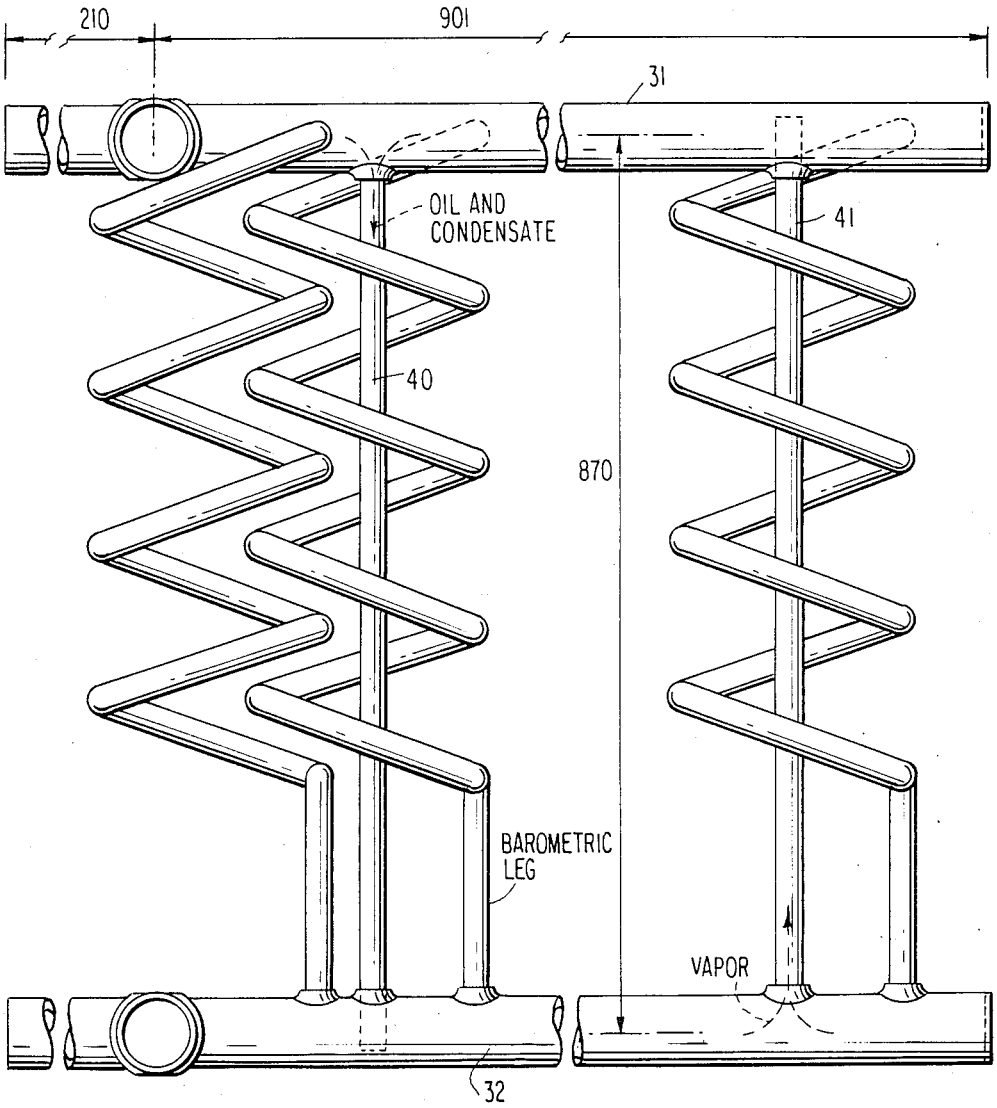
FIG. 4 is a side sectional view of a typical header and helical tube pack incorporating the invention.
Figure 5A:
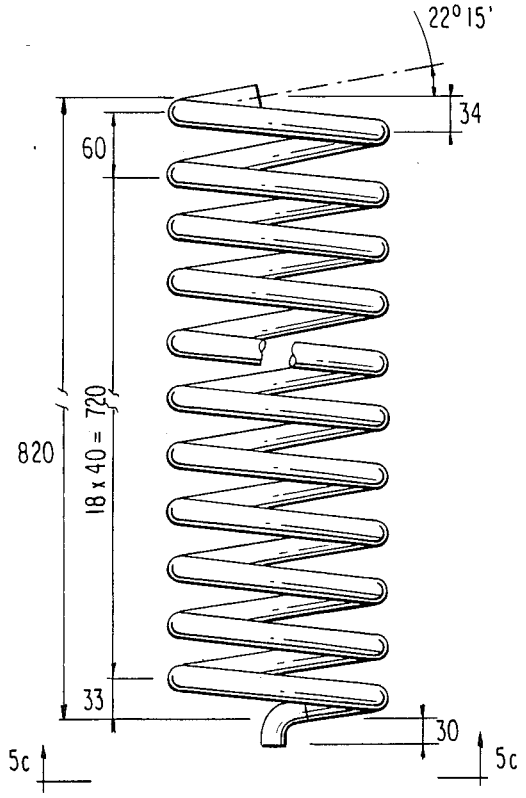
FIGS. 5*a*, 5*b* and 5*c* illustrate a single helical tube assembly of copper with exemplary dimensions therefor.
Figure 5B:
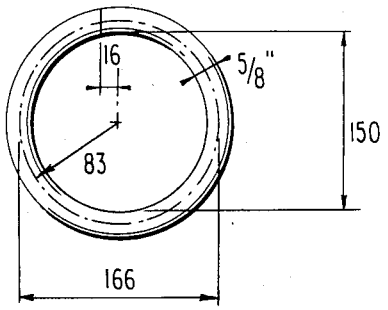
Figure 5C:
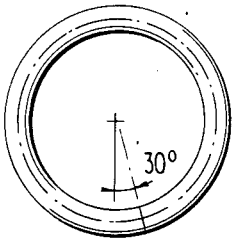
Figure 6:
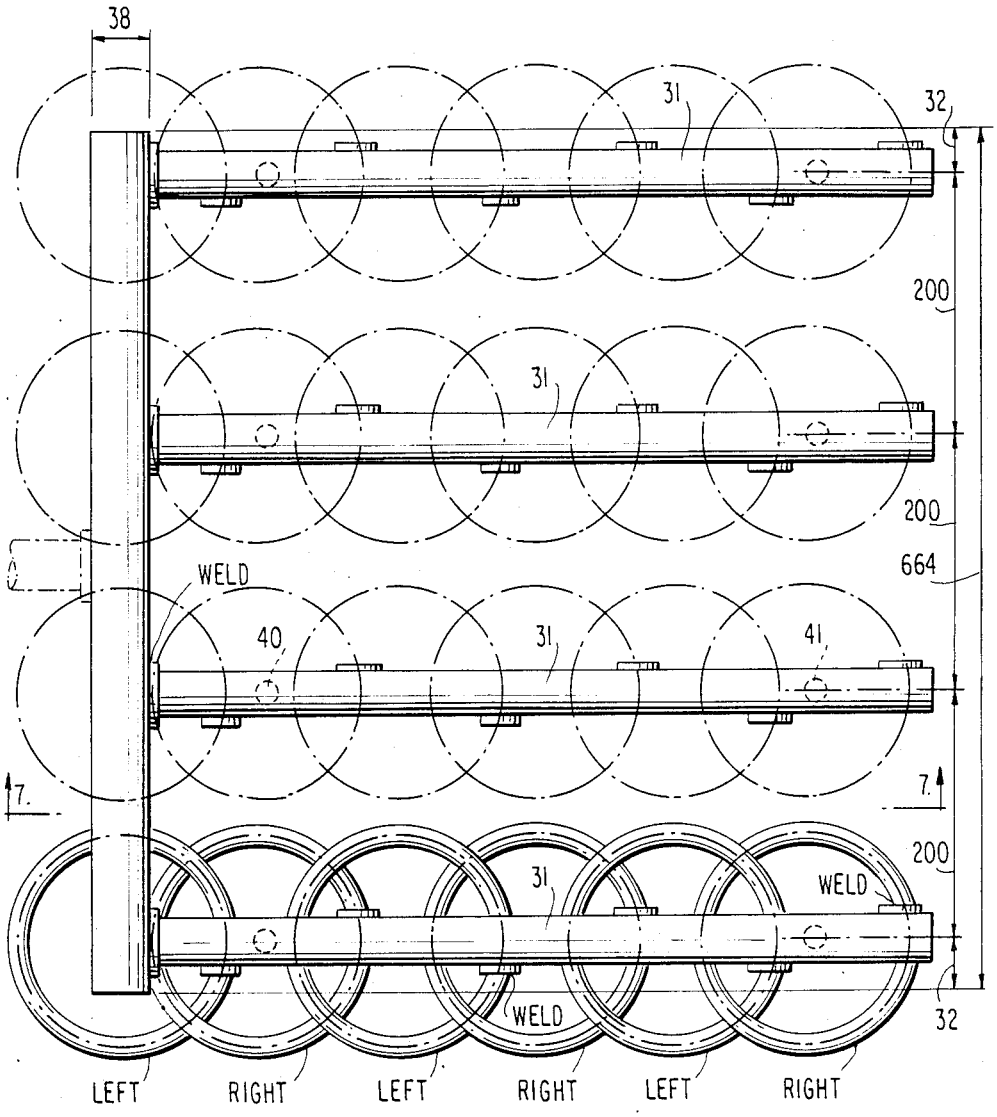
FIG. 6 is a top plan view showing coupling of the upper vertical header pipe means to the source and the side connection of the upper reach or helix of the helical tubes to its respective header and above the lower surface of the header.
Figure 7:
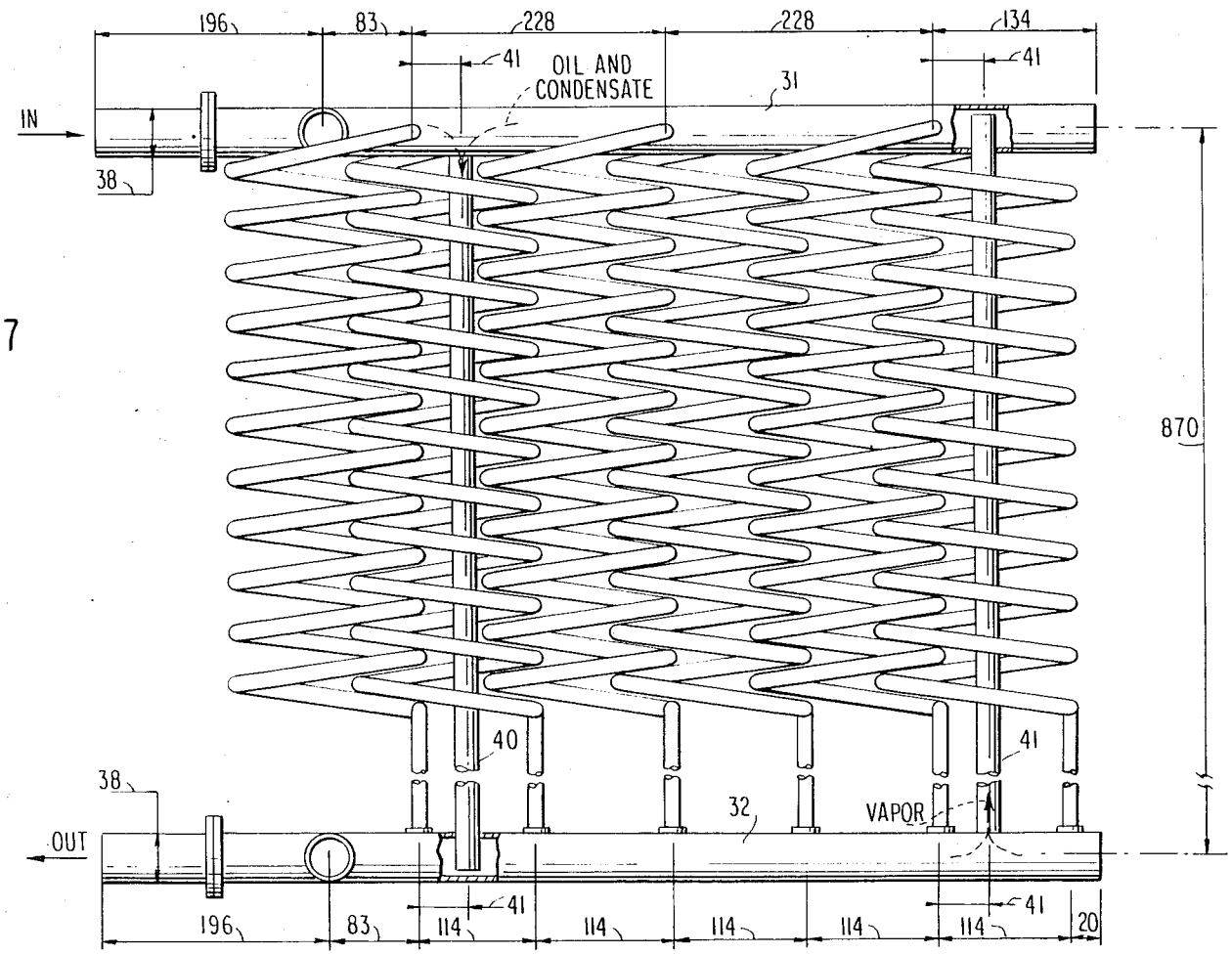
FIG. 7 is a side-elevational view thereof with exemplary dimensions provided.

As shown in the side and top views of FIGS. 4, 6 and 7, the coils also interlink one another which results in a greater compactness of the heat exchanger as well as forming a labrynithic path for the water dripping down through the coils.

The labrynithic paths means greater break-up of the mass of water and this will increase the evaporative surface so that the air will be more in contact with the water. This is the evaporative heat transfer identified as stage 4 of the overall process.

FIG. 4 shows one of the preferred arrangements. Other arrangements incorporating the basic premise of the invention will be apparent to those skilled in the art.

The hot gas or vapor enters the distribution header 31. A distance separator pipe 40 only penetrates the bottom of header 31 but the opposite end is sunk into header 32. As will be more fully explained later, this serves as a gravimetric drain so any droplets of oil or condensed refrigerant coming in with the hot gas will drain down directly into the condensate or liquid header 32 thus minimizing the film build-up in the inside surfaces of the coils.

Column or pipe 41 located at the opposite end of header 31 and 32 acts as a vent for any vapor trapped in condensate header 32 and also equalizes pressure.

As shown in FIG. 7 and FIG. 8*a*, the coils have rings through length EV and a short straight length BL. The length EV is a heat exchanging surface. The length BL acts as a barometric leg. The height of BL is calculated on the basis that the hydrostatic pressure of the liquid column BL is equal to the friction loss of the vapors condensing all along the coil length.

This method of using an independent barometric leg on each coil takes care of the fluctuation condensing rates of each coil which could otherwise provoke vapor locks and thus reduce the overall heat output of the unit. If barometric legs BL were not used and the pipes were coiled in their full length, any condensed liquid build-up would cancel out that portion or length of pipe as heat exchanging surface. In this instance, those liquid flooded pipe rings will be a waste of material. However, it is to be understood that the barometric leg is an additional feature of the invention.

The span between header 31 and 32 is set and fixed by the length of elements 40 and 41. If the distance between elements 40 and 41 became too great, more of these elements could be added on however, they can also be replaced by a simple pipe 42 which can be blanked off on both ends without having penetrated the header 31 or 32.

Coils 21 are fixed at each end onto the header 31 and 32. For reasons to be explained later, it is convenient to install the coils in a manner that they stay tensionized or under tension. In practice, the average length of each coil will be approximately 13 to 15 times the span between the header 31 and 32.

When the condensor is at work, and because pipes 40, 41 and 42 have fixed the span, all thermal expansion of the coils will have to be taken up by each ring causing an increase of the ring's diameter.

The coils are made out of metal, copper, aluminum, steel, etc., which, by their physical properties have the necessary flexibility or elasticity to remain or stay unharmed after this continuous expanding and contraction.

Any scale which could add grit onto the surface of the pipe coil has the characteristics of being a rigid non-flexible material. It is also an extremely poor conductor. As taught in my above referred to patents, the change of shape or dimension of the pipe coil cannot be accompanied by the rigid scale. The ultimate result is that the scale will chip off and will be washed down by the cooling water.

Earlier it was mentioned that it is very convenient to install the coils under tension just as if they were tensionated strings. This procedure will promote a more intense vibration of the coils everytime the cooling water droplets hit the metal. These vibrations cause a rejection of any scale deposits.

According to the invention, the struts or support columns 40, 41 and 42 of the heat exchanger besides serving as gravimetric (gravity operated) liquid condensate drains and as passing vapor from the lower header to the upper header, limit the height of the position of the headers and therefore, the helical pipes can only expand or move radially. The rings can only change its shape radially or diametrically which helps to break off the scale which may have adhered to the surface. Also, because of the spiral shape and the way it's welded at the top header and the bottom header and because it has independent supporting columns 40, 41, and 42 the material and the thickness of the helical pipe is extremely thin and all it has to do is have enough strength to resist the pressure of the refrigerant. It does not have to support itself between supports and avoids the problem of span length, etc. A further advantage of the invention is that it design allows for between a 30 to 50 percent less weight in copper tubes or aluminum or steel tubes. Also, the design is such that there are right hand and left hand coils which allows them to fit in very snug and by doing so, the invention permits more advantageous use of the reduction of volume of the condensor. When the water starts dripping down here it finds the coils—in other words, it finds pipes where to hit and splashing back and forth and so on.

The proper rate of flow and the diameter of the coil and the diameter of the ring itself then permits uses of the centrifugal force with a positive effect to keep the inside surfaces cleaner than if it were a horizontal flow. Also, because this follows a spiral path or coil path, the turbulence is used, even at low rates of flow of the refrigerant or the vapor coming, and, even in those low rates, we still get a far better heat transfer coefficient because of the shape of this coil. We have a turbulent flow where at the same velocity in a straight we would get a laminer flow. Also, assembly under tension helps to keep the vibration on the tubes.

In other words, before welding, we have a given height of for example, from here to here say there's 18 inches, okay, originally the coil was 17 inches, so it is sort of stretched out, like a spring, and welded to the vapor supply and condensate removal header. The purpose is to make sure that this will remain in tension. According to this invention, the coils are supportless. In other words, supports are not needed because of rigidity it takes—because of its round shape, its circular shape, this becomes a very rigid and consistent piece of pipe all the way up and we can do this with much thinner material than required on conventional designs. Tests with equal length of pipe on the conventional design and this invention show a 20 percent greater heat transfer. In other words, more BTU's are exchanged for the same surface with this invention than with the conventional. There is going to be a much higher heat transfer so that you can use less copper for the same thermal results.

While I have illustrated and described various preferred embodiments of the invention, it will be appreciated that the invention is subject to other modifications and adaptations which do not depart from the true spirit and scope of the invention as set forth in the claims appended hereto.

What I claim is:

1. Evaporative condensing apparatus including a bank of heat exchange pipes and means for spraying cooling liquid droplets onto the external surfaces of said pipes, comprising in combination, a pair of vertically spaced elongated headers, strut means secured to said headers for maintaining a fixed distance between said headers, said heat exchange pipes being constituted by a plurality of hollow helical pipes connected between said headers and having a substantially vertically oriented axis to avoid pooling of liquid and defining a plurality of helical flow paths between said headers, said cooling liquid droplets impinging on said hollow helical pipes to generate vibration and effect scale removal.

2. Evaporative condensing apparatus as defined in claim 1 wherein at least some of said helical pipes are in tension.

3. Evaporative condensing apparatus as defined in claim 1 including means between the lower ends of at least some of said helical pipes and the lower of said headers establishing a negative pressure on the column of vapor thereabove.

4. Evaporative condensing apparatus as defined in claim 1 wherein said upper header has a lower surface, and each said helical flow path connected to the upper one of said headers above the surface of any liquid in said upper header.

5. Evaporative condensing apparatus as defined in claim 4 including gravimetric by-pass means for draining liquid from said upper header to said lower header without passing through said helical flow paths.

6. Evaporative condensing apparatus as defined in claim 4 wherein at least one of said struts is hollow and is connected to said upper and lower headers so as to vent vapor from said lower header to said upper header and equalize vapor pressure therein.

7. A method of evaporative condensing of a vapor comprising, exerting a centrifugal force on the vapor by causing said vapor to traverse a plurality of helical paths, each said path having substantially vertical axis between a pair of fixed points, by coupling said vapor from a common upper vapor supply header to the interior of a plurality of hollow helical pipes having substantially vertical axis, gravimetrically exhausting the condensate in said pipes to a lower level condensate header, and spraying a liquid coolant in droplet form to impinge on the external surfaces of said hollow helical pipes to generate vibration and effect scale removal.

8. The method of evaporative condensing as defined in claim 7 including causing any liquid in said upper vapor supply header to flow to said condensate header without said liquid in said upper vapor header flowing through said helical flow paths.

9. The method defined in claim 7 including causing any vapor in said condensate header to flow to said vapor supply header without flowing through said helical flow paths.

10. The method of evaporative condensing defined in claim 7, including inducing a negative pressure at the lower end of said helical pipes.

11. The method of evaporative condensing defined in claim 10 wherein said negative pressure is induced by a vertical column of condensate coupled between the lower end of said helical pipes and said lower header.

12. An evaporative condenser having a pair of vertically spaced headers with the upper vapor supply header connected to a source of heat laden vapor and the lower condensate header connected to a utilization device, a plurality of condenser pipes connected between said headers and a source of cooling medium in droplet form impinging on and over the external surface of said condenser pipes, the improvement comprising, each said condenser pipe being thin walled and helically coiled between said headers with a substantially vertically oriented axis and having pitch and diameter such that gravity causes liquid condensate to flow rapidly from the upper helix of said helical coils to said lower header and maintain the maximum contact of vapor with the internal walls of said helically coiled condenser pipes, and said droplets of cooling liquid impinging on the external surfaces of said helical coil condenser pipe finds a continuous path on the external surfaces between said headers and rigid strut means between said headers.

13. The evaporative condenser defined in claim 12, wherein the thin walls of said helical condenser pipes are sufficient to contain the pressure vapor therein and helical condenser pipes are unsupported between said headers.

14. The evaporative condenser defined in claim 12, wherein the pipe between said helical coiled condenser pipe and said lower header is straight so that liquid condensate builds a head of liquid which acts as a siphon to place negative pressure on the column of vapor and condensed droplets upstream of the liquid column to assist in minimizing vapor lock.

15. The evaporative condenser defined in claim 12, wherein the coils are under tension and stretched to fit the axial length between headers.

16. The evaporative condenser defined in claim 12, wherein the upper ends of said helical coils connect into sides of said vapor supply header.

17. The evaporative condenser defined in claim 12, wherein said coils have pitch of about $1\frac{1}{2}''$ and a diameter of about 6.5" and are made of copper having a diameter of about 15 mm ($\frac{5}{8}''$) and a wall thickness of about 0.5 mm.

18. The evaporative condenser defined in claim 12, wherein said upper vapor supply header and said lower condensate headers are maintained in fixed spaced relation by at least one hollow liquid by-pass pipe connected to said headers so that liquid in the upper vapor supply header can flow by gravity to the lower condensate header, the lower end of each said pipe projecting into said lower condensate header such that the accumulation of condensed vapor and liquid blocks flow of vapor through said hollow liquid by-pass pipe.

19. The evaporative condenser defined in claim 18, including at least one further hollow vapor flow pipe wherein the upper end of one of said hollow vapor flow pipe projects above the lower surface of said upper vapor supply header pipe and above any liquid surface therein to permit vapor in said lower condensate header to rise to comingle with vapor in upper header and equalize pressure and avoid vapor locks in flow of condensate from said condenser.

20. Evaporative condensing apparatus comprising in combination, a pair of vertically spaced elongated tubular headers, strut means secured to said headers for maintaining a fixed distance between said headers, first and second pluralities of thin walled, hollow helical pipes between said headers and having a substantially vertically oriented axis to avoid pooling of liquid, and defining first and second plurality of parallel helical flow paths between said headers wherein, fluid flow in said first plurality of helical flow path is opposite rotationally than the flow path in said second plurality of helical flow paths, respectively.

21. Evaporative condensing apparatus as defined in claim 20 wherein alternate ones of said helical flow paths cause the vapor to flow in opposite rotational directions.

22. Evaporative condensing apparatus as defined in claim 20 wherein alternate ones of said helical pipes are wound in opposite directions from their neighbor and fit between rings of said neighbor.

23. Evaporative condensing apparatus as defined in claim 20 wherein at least some of said helical pipes are in tension.

24. Evaporative condensing apparatus as defined in claim 20 including means between the lower ends of at least some of said helical pipes and the lower of said headers establishing a negative pressure on the column of vapor thereabove.

25. Evaporative condensing apparatus as defined in claim 20 wherein said upper header has a lower surface, and each said helical flow path connected to the upper one of said headers above the surface of any liquid in said upper header.

26. Evaporative condensing apparatus as defined in claim 25 including by-pass means for draining liquid from said upper header to said lower header.

27. Evaporative condensing apparatus as defined in claim 25 including gravimetric by-pass means for draining liquid from said upper header to said lower header without passing through said helical flow paths.

28. Evaporative condensing apparatus as defined in claim 25 wherein at least one of said struts is hollow and is connected to said upper and lower headers so as to vent vapor from said lower header to said upper header and equalize vapor pressure therein.

29. Evaporative condensing apparatus as defined in claim 25 wherein alternate ones of said first and second pluralities of thin walled hollow helical pipes fit between neighboring helical pipes, respectively.

30. Evaporative condensing apparatus comprising in combination, a pair of vertically spaced elongated headers, a plurality of hollow strut means secured to said headers for maintaining a fixed distance between said headers, one or more of said hollow strut means constituting by-pass means for draining liquid from the upper header to the lower header, one or more of said hollow strut means being connected to vent vapor from said lower header to said upper header, a first plurality of thin walled helical pipes connected between said headers and having a predetermined pitch and a substantially vertically oriented axis to avoid pooling of liquid and defining a first plurality of helical flow paths between said headers, and a second plurality of thin walled hollow helical pipes connected between said headers and having a predetermined pitch and a substantially vertically oriented axis to avoid pooling of liquid and defining a second plurality of helical flow paths between said headers, fluid traversing said second plurality of helical flow paths flowing in opposite rotary directions than fluid traversing said first plurality of helical flow paths.

31. Evaporative condensing apparatus as defined in claim 30 wherein said upper header has a lower surface, and each said helical flow path connected to the upper one of said headers above the surface of any liquid in said upper header.

* * * * *